US006692838B2

(12) United States Patent
Ramanarayanan et al.

(10) Patent No.: US 6,692,838 B2
(45) Date of Patent: Feb. 17, 2004

(54) METAL DUSTING RESISTANT ALLOYS

(75) Inventors: Trikur Anantharaman Ramanarayanan, Somerset, NJ (US); ChangMin Chun, Lawrenceville, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 20 days.

(21) Appl. No.: 10/099,362

(22) Filed: Mar. 15, 2002

(65) Prior Publication Data

US 2003/0175544 A1 Sep. 18, 2003

(51) Int. Cl.[7] ..... B32B 15/04

(52) U.S. Cl. ..... 428/472.1; 428/472.2; 148/284; 148/286; 148/327; 148/329; 148/423; 148/424; 420/74

(58) Field of Search ..... 148/284, 286, 148/327, 329, 423, 424; 420/74; 428/472.1, 472.2

(56) References Cited

U.S. PATENT DOCUMENTS

| | | | | |
|---|---|---|---|---|
| 2,378,916 A | * | 6/1945 | Dean | 420/56 |
| 4,560,408 A | * | 12/1985 | Wilhelmsson | 420/46 |
| 4,602,968 A | | 7/1986 | Bergmann et al. | 148/31.5 |
| 5,630,887 A | | 5/1997 | Benum et al. | 148/280 |
| 6,475,310 B1 | | 11/2002 | Dunning et al. | 148/605 |
| 2002/0155306 A1 | | 10/2002 | Anada et al. | 428/472.1 |

FOREIGN PATENT DOCUMENTS

| | | | |
|---|---|---|---|
| WO | WO 02/14566 A1 | 2/2002 | C22C/19/05 |

* cited by examiner

*Primary Examiner*—Andrew L. Oltmans
(74) *Attorney, Agent, or Firm*—Estelle C. Bakun; Charles J. Brumlik

(57) ABSTRACT

The invention includes a composition of matter which is resistant to metal dusting and a method for preventing metal dusting on metal surfaces exposed to carbon supersaturated environments.

4 Claims, 2 Drawing Sheets

METAL DUSTING RESISTANT ALLOYS

FIELD OF THE INVENTION

The invention includes a method for controlling metal dusting corrosion in reactor materials exposed to carbon supersaturated environments and a composition of matter.

BACKGROUND OF THE INVENTION

In many hydrocarbon conversion processes, such as, for example the conversion of $CH_4$ to syngas, environments are encountered that have high carbon activities and relatively low oxygen activities. High temperature reactor materials and heat exchanger materials used in such processes can deteriorate in service by a very aggressive form of corrosion known as metal dusting.

Metal Dusting is a very deleterious form of high temperature corrosion experienced by Fe, Ni and Co-based alloys at temperatures in the range, 400–900° C. in carbon-supersaturated (carbon activity>1) environments having relatively low (about $10^{-10}$ to about $10^{-20}$ atmospheres) oxygen partial pressures. This form of corrosion is characterized by the disintegration of bulk metal into metal powder. Although many commercial alloys are available that are designed to form protective $Cr_2O_3$ or $Al_2O_3$ films in low oxygen partial pressure environments, the nucleation and growth kinetics of these oxides are often not fast enough to block carbon intrusion in environments with carbon activities in excess of unity.

Methodologies available in the literature to control metal dusting corrosion involve the use of surface coatings and gaseous inhibitors, especially $H_2S$. Coatings can degrade by interdiffusion of the coating constituents into the alloy substrate. Thus, while coatings are a viable approach for short-term protection, they are generally not advisable for long term service life of twenty years or more. Inhibition by $H_2S$ has two disadvantages. One is that $H_2S$ tends to poison most catalysts used in hydrocarbon conversion processes. Furthermore, $H_2S$ has to be removed from the exit stream which can substantially add to process costs.

What is needed in the art is an alloy composition that is resistant to metal dusting corrosion in low (about $10^{-10}$ to about $10^{-20}$ atmospheres) oxygen partial pressure and carbon-supersaturated (carbon activity>1) environments.

SUMMARY OF THE INVENTION

The invention includes a composition of matter which is resistant to metal dusting and comprises (a) an alloy capable of forming a protective oxide coating on its surface when exposed to a carbon supersaturated environment, (b) a protective oxide coating comprising at least two layers on said alloy surface which are formed when said alloy is exposed to metal dusting environments with low oxygen partial pressures. The outer layer, also referred to as the first layer (the layer contacting the carbon supersaturated environment or furthest away from the alloy) is made up of a thermodynamically stable oxide, which can rapidly cover up the alloy surface and block carbon entry into the alloy. The first layer is a thermodynamically stable manganese oxide which forms faster than the carbon in the supersaturated environment is able to penetrate the surface of the alloy. Hence the manganese oxide is referred to as a fast forming layer. Beneath the manganese oxide layer, a second layer forms (herein referred to as said second oxide layer) either simultaneously with or following said manganese oxide formation. The second layer of the protective oxide coating is an oxide film which is established beneath the manganese oxide layer and adherent to the manganese oxide layer and its composition is dependent on the composition of the alloy from which it is formed. Hence the invention includes a composition resistant to metal dusting corrosion comprising (a) an alloy and (b) a protective oxide coating on said alloy, wherein said protective oxide coating comprises at least two oxide layers, wherein the first oxide layer is a manganese oxide layer and wherein said alloy comprises alloying metals and base metals, said alloying metals comprising a mixture of chromium and manganese and said base metals comprising iron, nickel and cobalt, and wherein said manganese is present in a concentration in said alloy of at least about 10 wt % Mn and said chromium is present in said alloy at a concentration of at least about 25 wt % Cr and wherein the combined amount of chromium and manganese$\geqq$40 wt % and wherein said first oxide layer is the layer furthest away from said alloy surface.

The protective oxide coating may be formed in situ during use of the alloy in a carbon supersaturated environment, or prepared by exposing the alloy to a carbon supersaturated environment prior to the alloys use. A benefit of the invention is that if the protective oxide coating cracks during use of the alloy in a carbon supersaturated environment, the protective coating will form in the crack to repair the oxide layers thereby protecting the alloy from metal dusting during use.

The invention also includes a method for preventing metal dusting of metal surfaces exposed to carbon supersaturated environments comprising constructing said metal surface of, or coating said metal surfaces with a metal dusting resistant alloy composition comprising a metal alloy comprising alloying metals and base metals, said alloying metals comprising a mixture of chromium and manganese and said base metals comprising iron, nickel and cobalt, and wherein said manganese is present in a concentration in said alloy of at least about 10 wt % Mn and said chromium is present in said alloy at a concentration of at least about 25 wt % Cr and wherein the combined amount of chromium and manganese$\geqq$40 wt % and wherein said first oxide layer is the layer furthest away from said alloy surface.

The metal surfaces may be constructed of the alloy or coated with the alloy and the protective oxide film described above will be formed in situ during operation of the unit in a carbon supersaturated environment.

Hence the invention further comprises a protective oxide coating comprising at least two oxide layers wherein said first layer is a manganese oxide layer and said first layer is the layer furthest away from said alloy on said alloy.

DETAILED DESCRIPTION OF THE INVENTION

Figure 1:
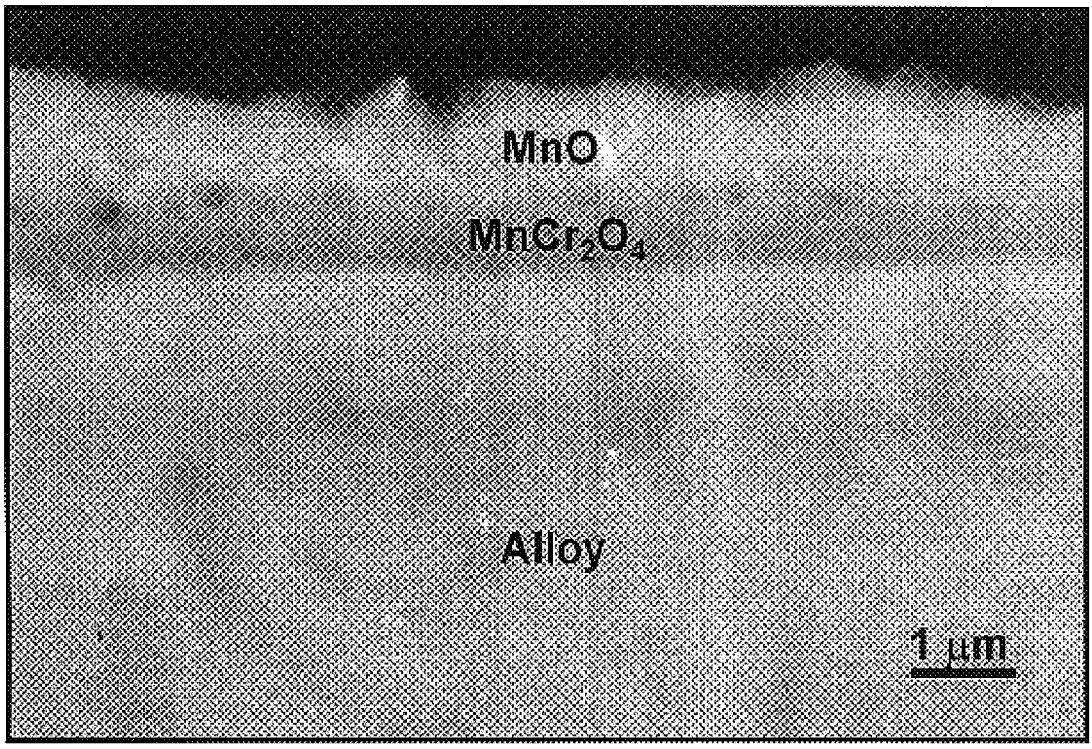
FIG. 1 depicts scanning electron microscopic image of the two layered protective oxide films for an alloy of composition, 20.1Fe-39.4Ni-10.0Mn-30.5Cr after metal dusting at 650° C. for 160 hours in 50CO-50$H_2$.

The alloys on which the protective films described herein are formed include alloys containing a combination of both chromium and manganese. The chromium and manganese are herein referred to as the alloying elements. In addition to the alloying elements, the alloys will contain base metals. The base metals form the majority of the alloy and hence are present in amounts greater than about 44% in total. Thus, in addition to the chromium and manganese, other metals, herein referred to as base metals can be present in the alloys and include iron, nickel, cobalt and mixtures thereof. Additional alloying elements such as silicon and aluminum may also be present in the alloys. Preferably Fe—Ni—Mn—Cr alloys will be utilized.

The base metals forming the alloys herein are selected from iron, nickel and cobalt as well as mixtures of the three. The base metals can be present in any combination or only a single base metal can be used to form the alloys.

TABLE 1

The Mass Gain Due to Carbon Deposition (a measure of metal dusting corrosion) on Linde B Finished Surface of Various Fe—Ni—Mn—Cr Alloys at 550° C. and 650° C. in 50CO—50$H_2$ Gas Mixture after 160 Hours of Corrosion.

| Alloy Compositions (Weight %) | Amount of (Mn + Cr) (Weight %) | Mass Gain (mg/cm$^2$) at 550° C. | Mass Gain (mg/cm$^2$) at 650° C. |
|---|---|---|---|
| 30.4Fe:30.4Ni:14.7Mn:24.5Cr | 39.2 | 118.0~122.0 | 90.0~95.0 |
| 20Fe:40.5Ni:14.9Mn:24.6Cr | 39.5 | 65.0~67.0 | 28.0~32.0 |
| 20.1Fe:39.4Ni:10.0Mn:30.5Cr | 40.5 | 21.0~24.0 | No Carbon |
| 30.0Fe:29.5Ni:10.2Mn:30.3Cr | 40.5 | 17.0~19.0 | No Carbon |
| 19.7Fe:32.9Ni:14.4Mn:33.0Cr | 47.4 | 0.7~0.9 | No Carbon |
| 14.8Fe:39.3Ni:14.9Mn:31.0Cr | 45.9 | 0.5~0.9 | No Carbon |
| 45.0Fe:29.5Mn:25.5Cr | 55.0 | 0.2~0.5 | No Carbon |
| 24.9Fe:19.6Ni:28.9Mn:26.6Cr | 55.5 | 0.7~1.2 | No Carbon |
| 59.8Ni:14.0Mn:26.2Cr | 40.2 | 1.2~1.7 | No Carbon |
| 7Fe:77Ni:16Cr (In600)* | | 120.0~130.0 | 60.0~65.0 |
| 20Fe:45Ni:35Cr (35/45)** | | 230.0~250.0 | 140.0~160.0 |

*Inconel 600 alloy (N06600)
**35/45 carburization-resistant alloy (KHR-45A)

The alloys of the instant invention may be utilized to construct the apparatus surfaces which will be exposed to metal dusting environments, or existing surfaces susceptible to metal dusting can be coated with the alloys by techniques common to the skilled artisan. For example, techniques such as thermal spraying, plasma deposition, chemical vapor deposition, and sputtering can be used. Hence, refinery apparatus can either be constructed of or coated with the alloys described herein and the protective oxide films formed during use of the apparatus, or formed prior to use of the apparatus.

When utilized as coatings on existing surfaces, the thickness of such coatings will range from about 10 to about 200 microns, preferably from about 50 to about 100 microns.

Surfaces which would benefit from the instant invention as a coating include surfaces of any apparatus or reactor system that is in contact with carbon supersaturated environments at any time during use, including reactors, heat exchangers, piping etc.

The protective coatings or films on the surface of the alloys described herein are formed on the alloy surface by exposing the alloy to a metal dusting environment such as a 50CO:50$H_2$ mixture. Hence, the protective coatings can be formed during or prior to use of the alloys under reaction conditions in which they are exposed to metal dusting environments. The preferred temperature range is from about 350° C. to about 1050° C., preferably from about 550° C. to about 1050° C. Typical exposure times can range from about 1 hour to about 200 hours, preferably from about 1 hour to about 100 hours.

The following examples are meant to be illustrative and not limiting.

EXAMPLES

Alloys containing different concentrations of Fe, Ni, Mn and Cr were prepared by arc melting. The arc-melted alloys were rolled into thin sheets of about 1/16 inch thickness. The sheets were annealed at 1100° C. overnight in inert argon atmosphere and furnace-cooled to room temperature. Rectangular samples of 0.5 inch×0.25 inch were cut from the sheets. The sample faces were polished to either 600-grit finish or Linde B (0.05 micrometers alumina powder) finish and cleaned in acetone. Specimens from all of the melts used in the metal dusting experiments were analyzed by energy dispersive X-ray spectroscopy (EDXS) attached in scanning electron microscopy. The results of the chemical analyses are shown in Table 1. The specimens were exposed to a 50CO-50$H_2$ gaseous environment for 160 hours. This is a particularly aggressive gas mixture in which most high temperature alloys undergo metal dusting. Several candidate commercial alloys were also exposed to the same conditions.

Figure 2:
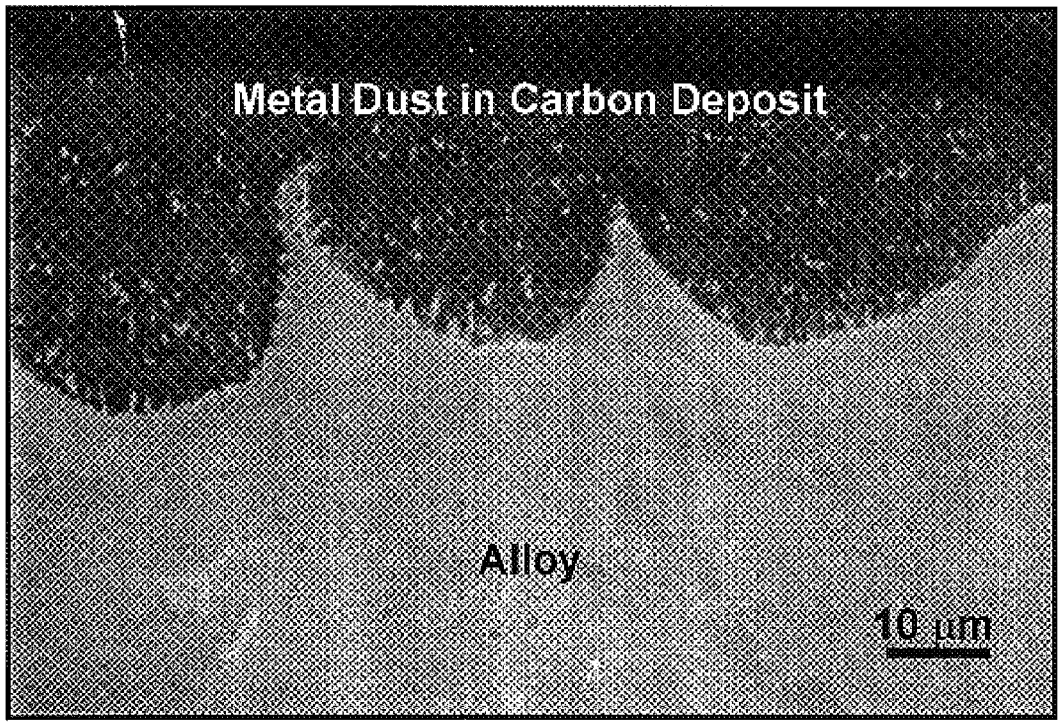
FIG. 2 depicts scanning electron microscopic image of the pitting morphology for a carburization-resistant alloy (35/45) of composition, 20Fe-45Ni-35Cr after metal dusting at 650° C. for 160 hours in 50CO-50$H_2$.

Detailed electron microscopy of the alloys after exposure indicated that specific alloy compositions in the Fe—Ni—Mn—Cr system were resistant to metal dusting corrosion. A two layered protective oxide film consisting of an outer layer of MnO and an inner layer of $MnCr_2O_4$ was identified as the reason for the observed metal dusting resistance. Shown in FIG. 1 are scanning electron microscopic image of the two layered protective film for an alloy of composition, 20.1Fe:39.4Ni:10.0Mn:30.5Cr after exposure to a carbon supersaturated metal dusting environment (50CO-50$H_2$) at about 650° C. for 160 hours in 50CO-50$H_2$. No carbon deposition, which always accompanies metal dusting corrosion, was observed on the sample surface. A carburization-resistant commercial alloy of composition shown in FIG. 2 suffered extensive metal dusting attack. The electron microscopic image shown in FIG. 2 indicate the pitting morphology, characteristic of metal dusting, in the corroded regions after metal dusting at 650° C. for 160 hours in 50CO-50$H_2$. Carbon deposition, which invariably accompanies such attack, is also seen in FIG. 2.

The resistance of Fe—Ni—Mn—Cr alloys to metal dusting corrosion at 550° C. and 650° C. is shown in Table 1. Since metal dusting is generally accompanied by carbon deposition, the mass gain due to carbon deposition can be used as a measure of metal dusting corrosion. After corrosion in 50CO-50$H_2$ gas mixture for 160 hours at 550° C. and 650° C., respectively, mass gain on Linde B finished surface of various Fe—Ni—Mn—Cr alloys were measured.

We claim:

1. A composition resistant to metal dusting corrosion comprising (a) an alloy and (b) a protective oxide coating on said alloy, wherein said protective oxide coating comprises at least two oxide layers, wherein the first oxide layer is a manganese oxide layer and wherein said alloy comprises alloying metals and base metals, said alloying metals comprising a mixture of chromium and manganese and said base metals comprising iron, nickel and cobalt, and wherein said manganese is present in a concentration in said alloy of at least about 10 wt % Mn and said chromium is present in said alloy at a concentration of at least about 25 wt % Cr and wherein the combined amount of chromium and manganese≧40 wt % and wherein said first oxide layer is the layer furthest away from said alloy surface.

2. A method for preventing metal dusting of metal surfaces exposed to carbon supersaturated environments comprising constructing said metal surface of, or coating said metal surfaces with a metal dusting resistant alloy composition comprising a metal alloy comprising alloying metals and base metals, said alloying metals comprising a mixture of chromium and manganese and said base metals comprising iron, nickel and cobalt, and wherein said manganese is present in a concentration in said alloy of at least about 10 wt % Mn and said chromium is present in said alloy at a concentration of at least about 25 wt % Cr and wherein the combined amount of chromium and manganese≧40 wt % and wherein said first oxide layer is the layer furthest away from said alloy surface.

3. The method of claim 2 wherein said alloy is exposed to a carbon supersaturated metal dusting environment and a protective oxide coating is formed on said alloy surface wherein said protective oxide coating comprises at least two oxide layers, wherein the first oxide layer is a manganese oxide layer and wherein said first oxide layer is the layer furthest away from said alloy surface.

4. The method of claim 3 wherein said protective oxide coating is formed in situ during use of said alloy in a carbon supersaturated metal dusting environment.

* * * * *